US009853362B2

(12) United States Patent
Kim et al.

(10) Patent No.: US 9,853,362 B2
(45) Date of Patent: Dec. 26, 2017

(54) ARRAY ANTENNA APPARATUS FOR ROTATION MODE, AND WIRELESS COMMUNICATION TERMINAL AND METHOD

(71) Applicant: Electronics and Telecommunications Research Institute, Daejeon (KR)

(72) Inventors: Bong Su Kim, Daejeon (KR); Min Soo Kang, Daejeon (KR); Kwang Seon Kim, Daejeon (KR); Woo Jin Byun, Daejeon (KR); Mi Kyung Suk, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 410 days.

(21) Appl. No.: 14/723,657

(22) Filed: May 28, 2015

(65) Prior Publication Data

US 2016/0156099 A1 Jun. 2, 2016

(30) Foreign Application Priority Data

Nov. 27, 2014 (KR) ..... 10-2014-0167555

(51) Int. Cl.
*H01Q 3/01* (2006.01)
*H01Q 3/26* (2006.01)
*H01Q 21/06* (2006.01)

(52) U.S. Cl.
CPC ..... *H01Q 21/061* (2013.01); *H01Q 3/26* (2013.01)

(58) Field of Classification Search
CPC ..... H01Q 3/01; H01Q 3/08; H01Q 3/26
USPC ..... 342/359, 372, 373; 343/754, 763
See application file for complete search history.

(56) References Cited

U.S. PATENT DOCUMENTS

| | | | | |
|---|---|---|---|---|
| 6,249,250 | B1 * | 6/2001 | Namekata | H01Q 1/246 342/372 |
| 7,027,421 | B2 | 4/2006 | Park et al. | |
| 9,640,866 | B2 * | 5/2017 | Kumar | H04B 7/086 |
| 2002/0057660 | A1 | 5/2002 | Park et al. | |
| 2012/0123752 | A1 | 5/2012 | Yun | |

(Continued)

FOREIGN PATENT DOCUMENTS

| | | | |
|---|---|---|---|
| JP | 07131239 | A | 5/1995 |
| JP | 0897620 | A | 4/1996 |

OTHER PUBLICATIONS

Andres Garcia-Aguilar, "Printed Antenna for Satellite Communications," Radiation Group. Signals, Systems, and Radiocommunications Dept., Universidad Politecnica de Madrid, Madrid, Spain.

*Primary Examiner* — Dao Phan
(74) *Attorney, Agent, or Firm* — William Park & Associates Ltd.

(57) ABSTRACT

The present invention provides an array antenna apparatus for a rotation mode, a wireless communication terminal, and a method thereof. The apparatus according to the exemplary embodiment includes an antenna array including a plurality of antenna elements; and a control unit which determines an antenna pattern in accordance with a transmission/reception characteristic of a signal and assigns a weight to antenna elements in a position corresponding to the determined antenna pattern on the antenna array to implement a rotation mode antenna based on the antenna element to which the weight is assigned.

16 Claims, 11 Drawing Sheets

(56) References Cited

U.S. PATENT DOCUMENTS

2014/0184440 A1* 7/2014 Park ..... H01Q 25/04
342/351

* cited by examiner

[FIG.1]
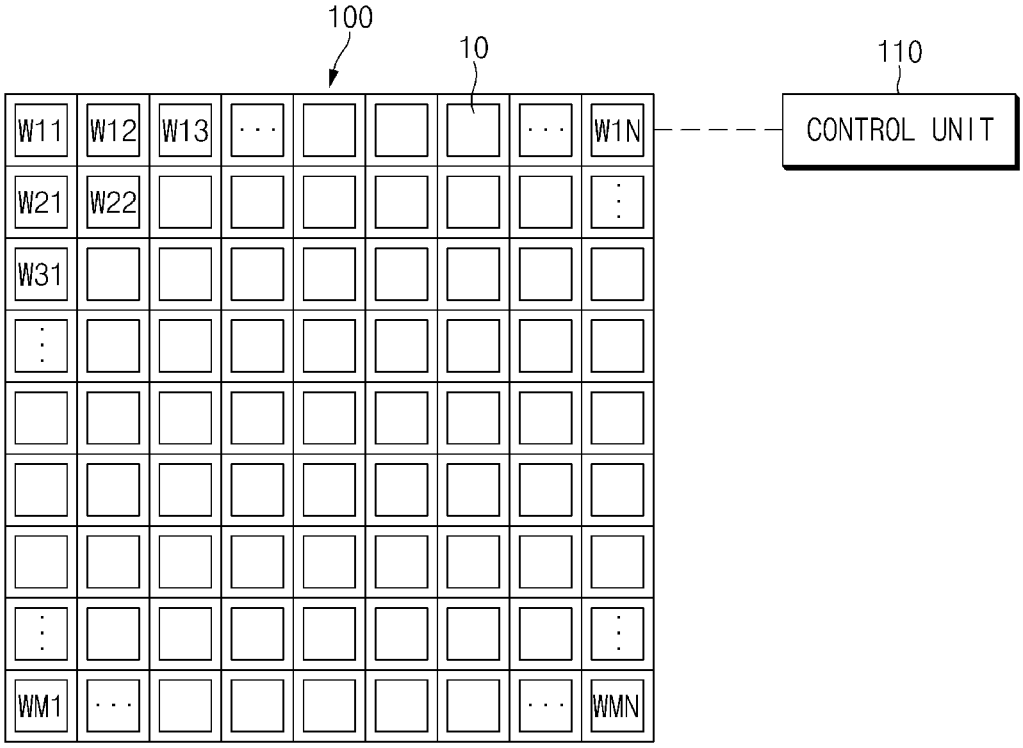

[FIG.2A]
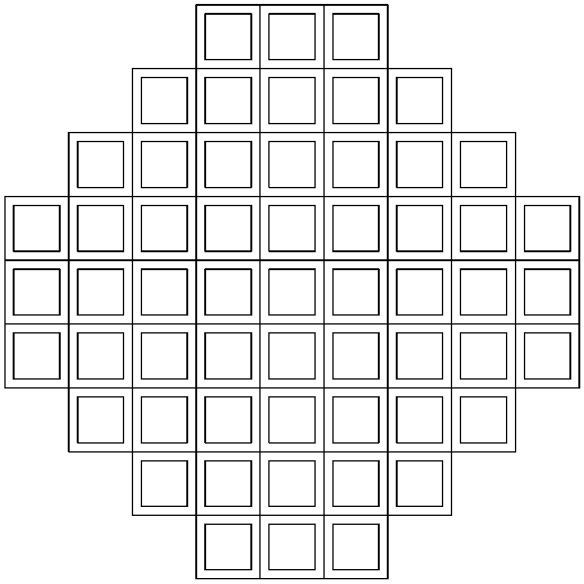
[FIG.2B]
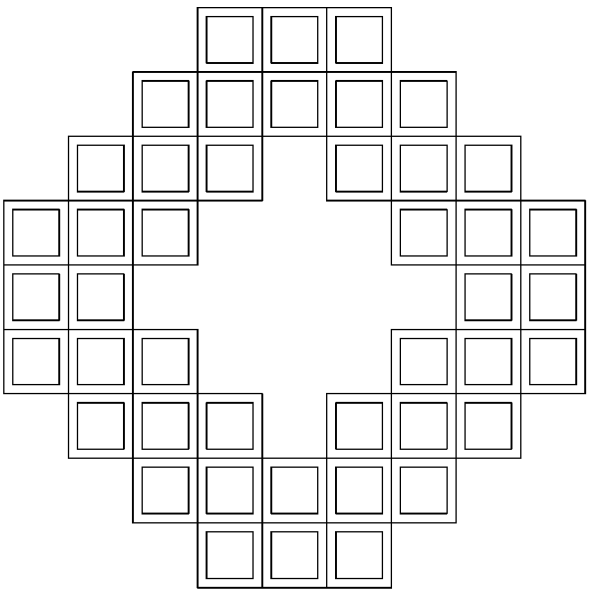

[FIG.2C]
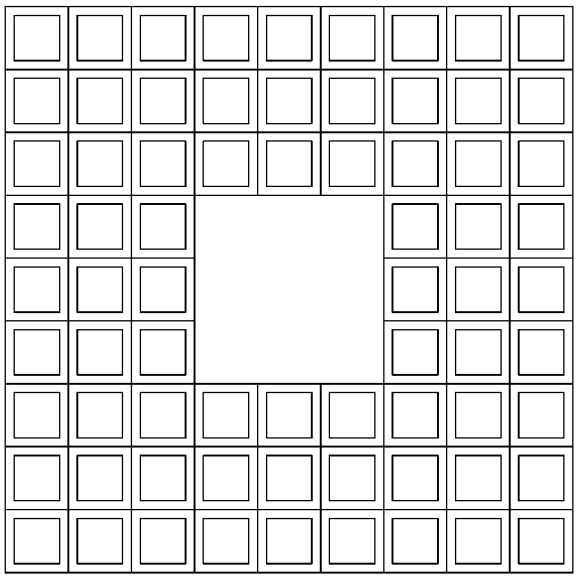
[FIG.3]
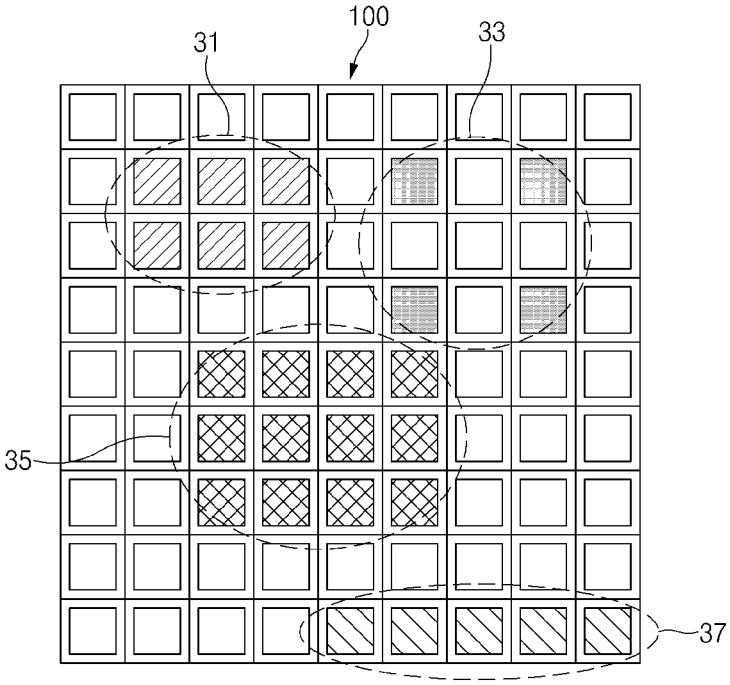

[FIG.4A]
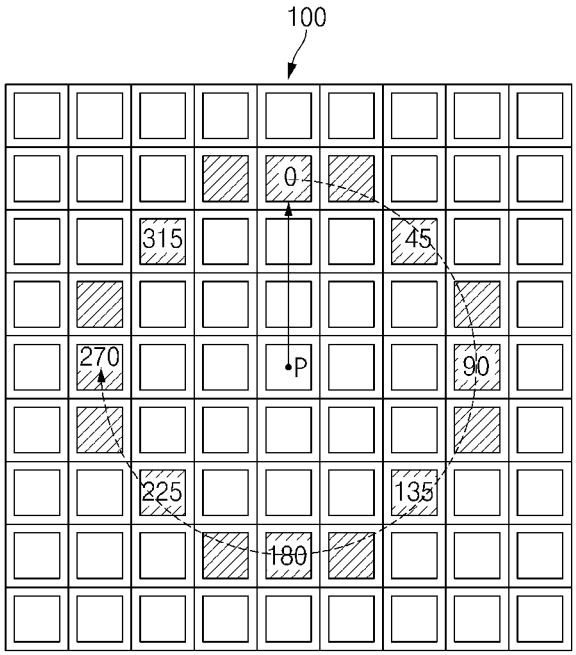
[FIG.4B]
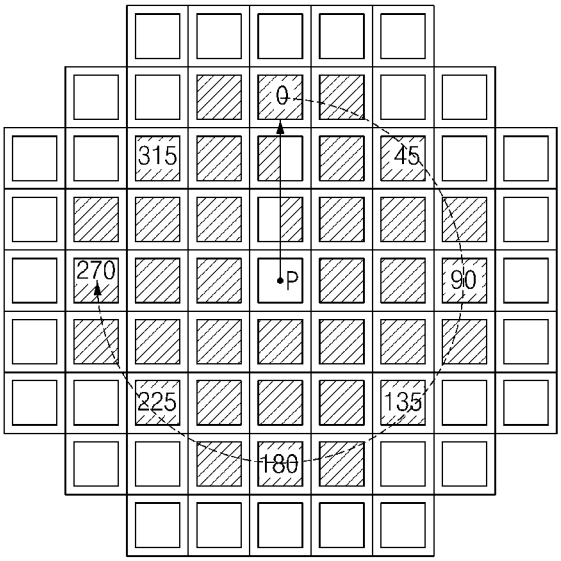

[FIG.5A]
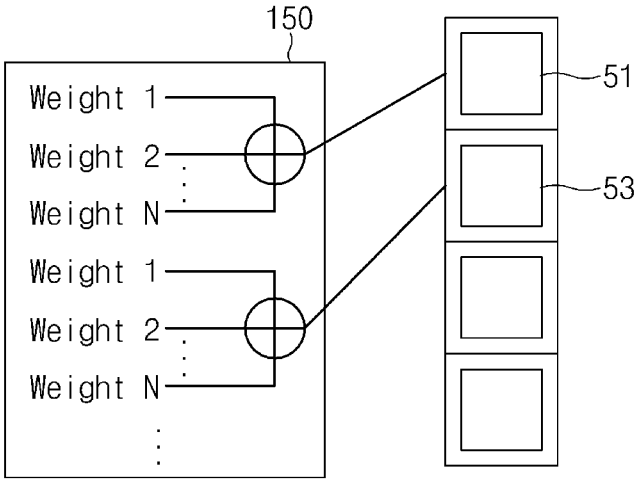
[FIG.5B]
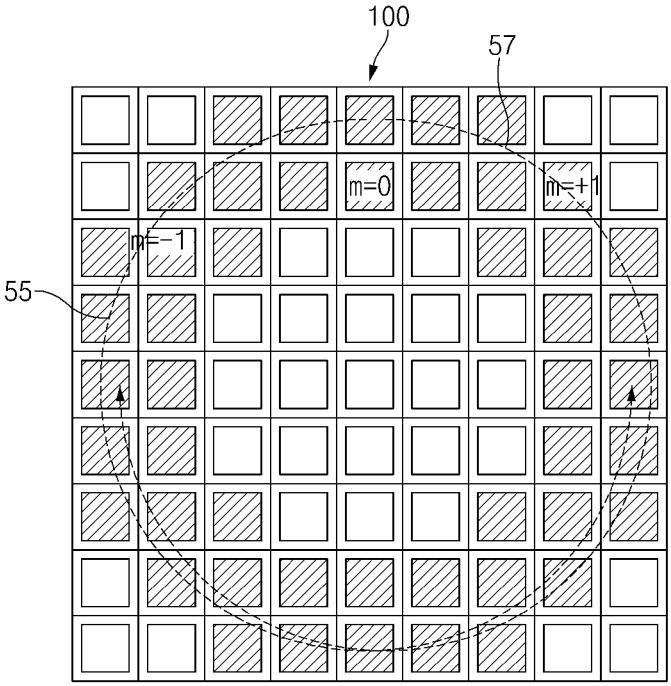

[FIG.6A]
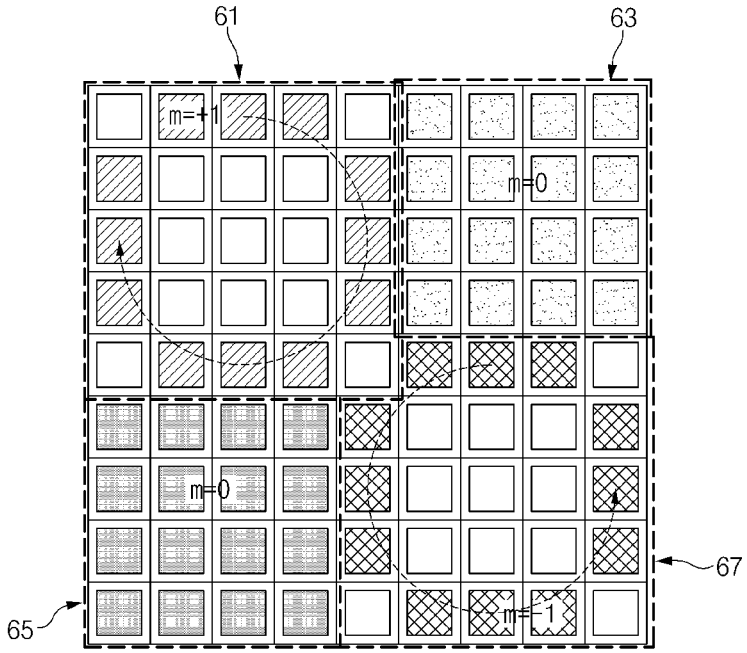
[FIG.6B]
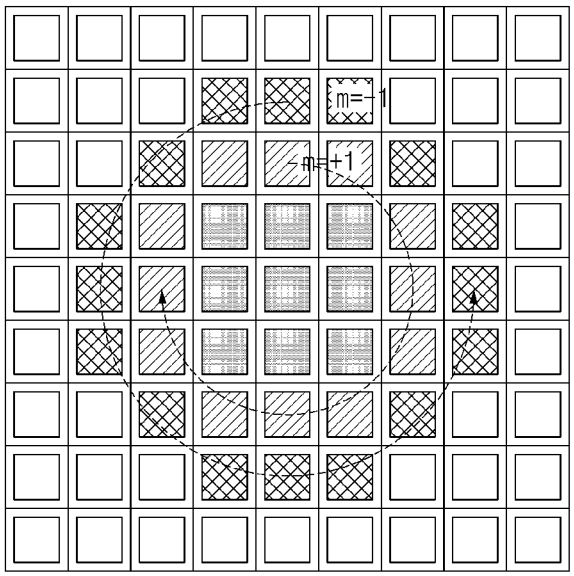

[FIG.6C]
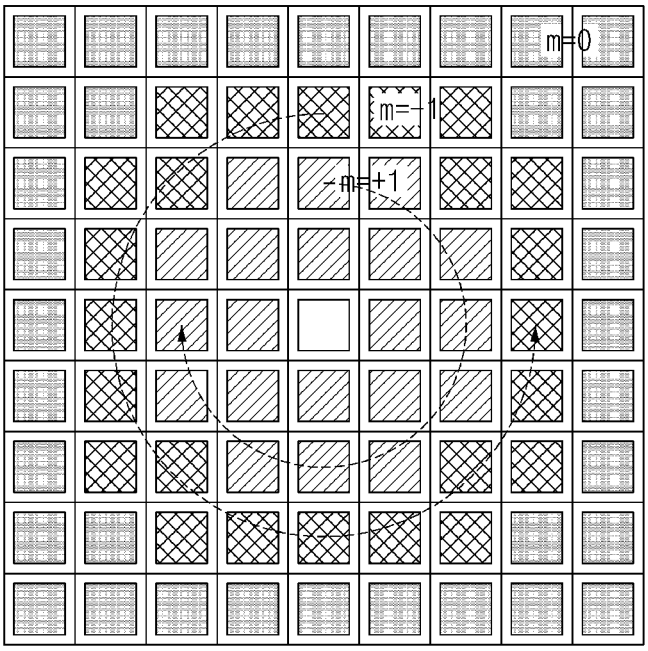
[FIG.6D]
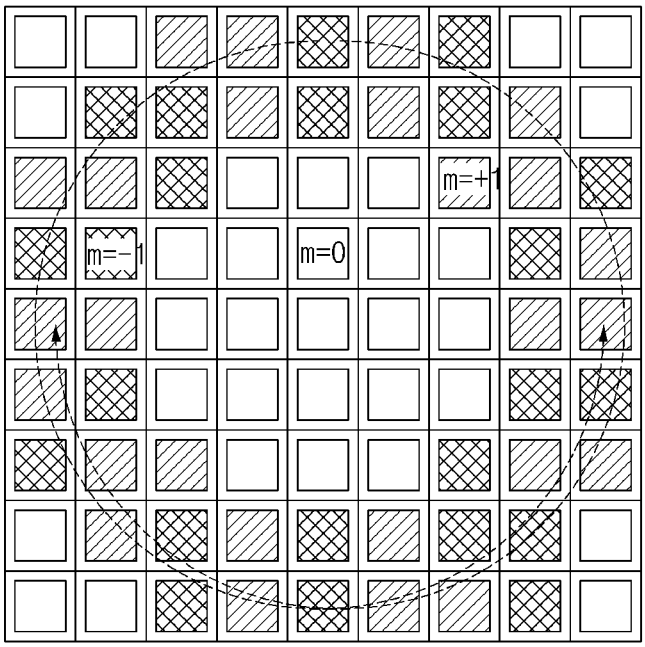

[FIG.6E]
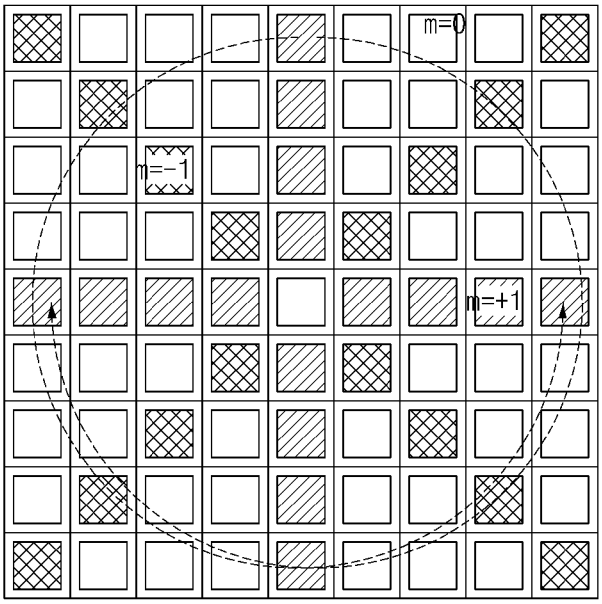
[FIG.7A]
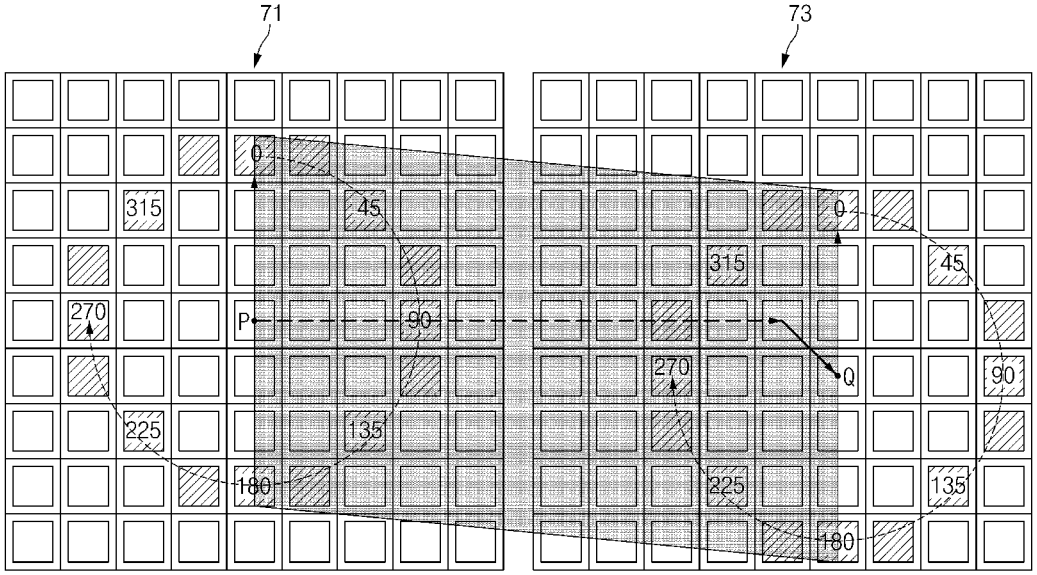

[FIG.7B]
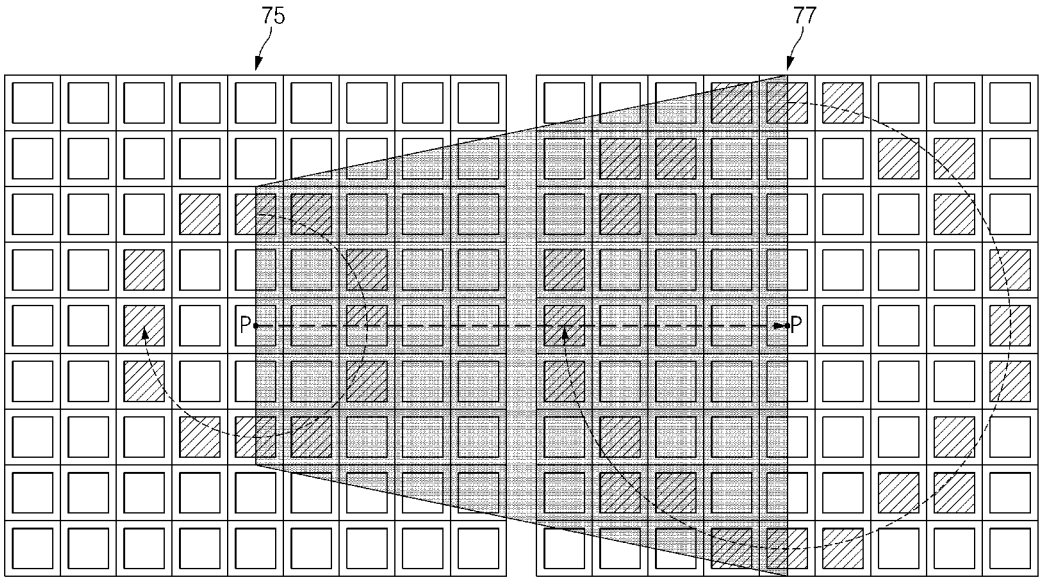
[FIG.8]
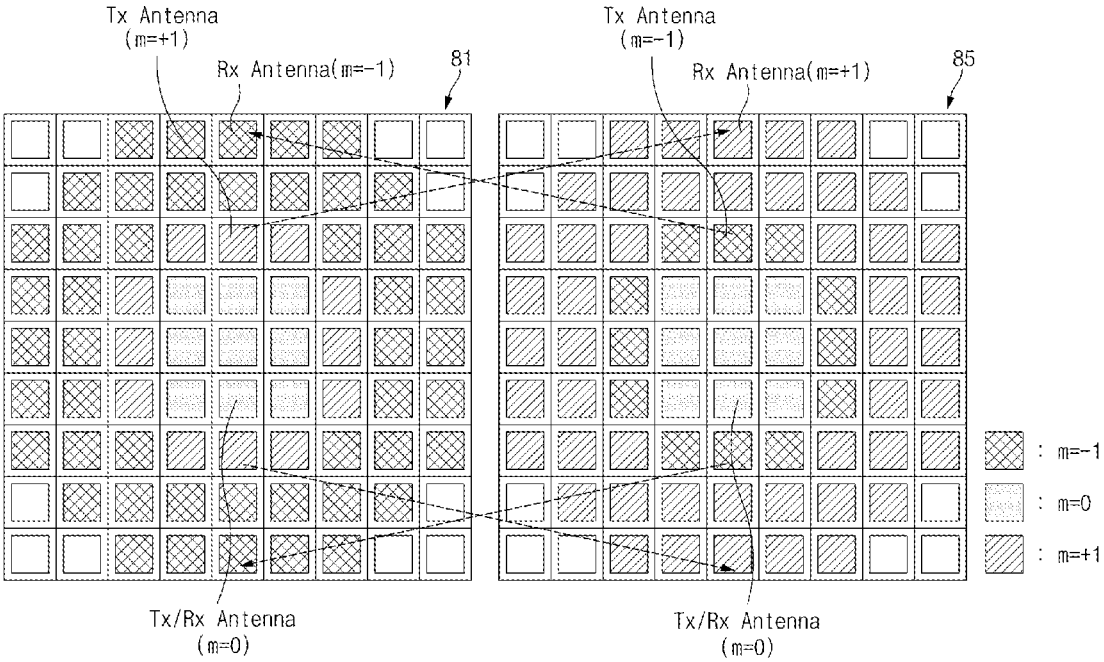

[FIG.9]
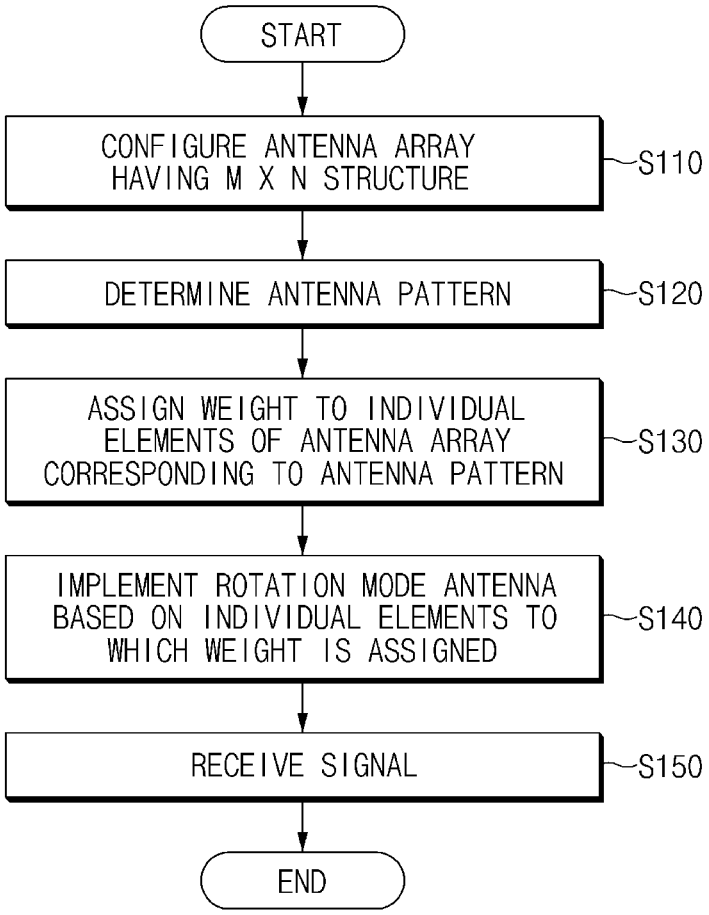

[FIG.10]
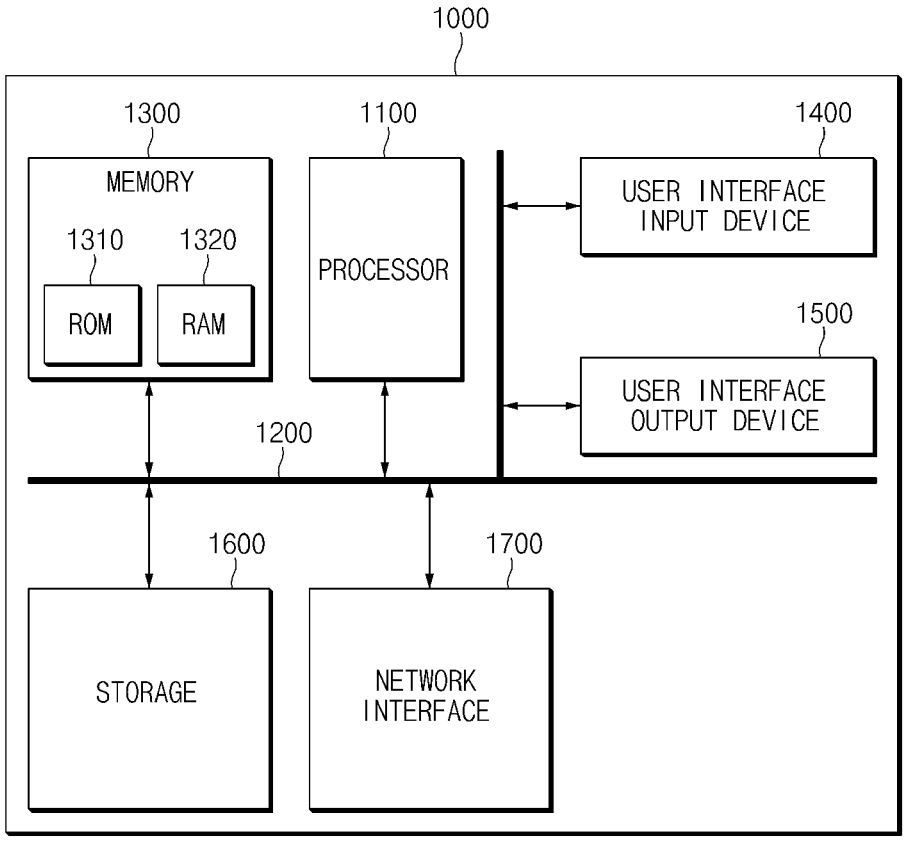

ARRAY ANTENNA APPARATUS FOR ROTATION MODE, AND WIRELESS COMMUNICATION TERMINAL AND METHOD

CROSS-REFERENCE TO RELATED APPLICATIONS

This application claims priority to and the benefit of Korean Patent Application No. 10-2014-0167555 filed in the Korean Intellectual Property Office on Nov. 27, 2014 the entire contents of which are incorporated herein by reference.

TECHNICAL FIELD

The present invention relates to an array antenna apparatus for a rotation mode, a wireless communication terminal and a method thereof, and more particularly, to a technique of rearranging antenna patterns using a multi-arrayed antenna structure.

BACKGROUND ART

Since a wireless communication system has a limited available bandwidth, techniques using multi beam in the same channel have been studied in order to achieve a higher transmission rate. However, it is difficult to apply the technologies using the multi beam in the same channel to an actual circumstance due to a complex structure and a difficulty in a present circumstance.

Recently, a rotation mode (orbital angular momentum) of a multi beam antenna is actively studied. Using a fact that orthogonality is present between modes in the case of a rotation mode, a door to theoretically configure an infinite transmission channel is open. However, there is a limit in a technique of receiving a signal by applying the rotation mode to an actual wireless transmission channel.

For example, in the case of the rotation mode, a hole which does not have energy at a center is generated due to a radiation characteristic of an antenna and a radiation pattern expands in accordance with a distance. Therefore, there are lots of problems in a size of a reception antenna which receives a signal through the antenna.

SUMMARY OF THE INVENTION

The present invention has been made in an effort to provide an array antenna apparatus for a rotation mode which stably transmits and receives a signal by reconfiguring an antenna pattern in various modes using a multi arrayed antenna structure, a wireless communication terminal, and a method thereof.

An exemplary embodiment of the present invention provides an array antenna apparatus for a rotation mode including: an antenna array including a plurality of antenna elements; and a control unit which determines an antenna pattern in accordance with a transmission/reception characteristic of a signal and assigns a weight to the antenna elements in a position corresponding to the determined antenna pattern on the antenna array to implement a rotation mode antenna based on the antenna element to which the weight is assigned. Here, the control unit may implement a plurality of rotation mode antennas on the antenna array.

The control unit may implement at least two rotation mode antennas using one antenna pattern on the antenna array.

The array antenna apparatus for a rotation mode may further include a mode coupler which combines weights which are assigned to the antenna elements which form the one antenna pattern for every rotation mode antenna in the unit of antenna elements.

The control unit may assign the weights which are combined by the mode coupler corresponding to the antenna element which forms one antenna pattern to the corresponding antenna element.

The control unit may implement at least two rotation mode antennas using different antenna elements on the antenna array.

The control unit may implement a rotation mode antenna for every region using antenna elements in at least two regions which are spaced apart in parallel from each other on the antenna array.

The control unit may implement a rotation mode antenna for every region using antenna elements in at least two circle regions which are spaced apart from each other with respect to any one point on the antenna array.

The control unit may implement a rotation mode antenna for every region using antenna elements in line regions which extend in different directions with respect to any one point on the antenna array.

The control unit may implement at least two rotation mode antennas which intersect each other using antenna elements in at least two regions which overlap each other on the antenna array.

The control unit may analyze a reception power distribution of antenna elements which configure a reception side rotation mode antenna to rearrange antenna patterns of the rotation mode antenna in accordance with an analysis result.

The control unit may form the antenna pattern of the reception side rotation mode antenna to have the same shape as the antenna pattern of the transmission side rotation mode antenna but to be larger than the antenna pattern of the transmission side rotation mode antenna.

The control unit may implement a transmission side rotation mode antenna using antenna elements which are located at a center region of the antenna array and implement a reception side rotation mode antenna using antenna elements in an outer peripheral region which is spaced apart from the center region.

The weight may be determined depending on an amplitude and a phase of a signal which is transmitted or received through the rotation mode antenna.

A gain of the rotation mode antenna may be increased in proportion to the number of antenna elements corresponding to the antenna pattern.

In the meantime, another exemplary embodiment of the present invention provides a wireless communication terminal which includes the array antenna apparatus for a rotation mode described above and transmits and receives a wireless signal using the array antenna apparatus for a rotation mode.

Another exemplary embodiment of the present invention provides a wireless communication method, including: configuring an antenna array including a plurality of antenna elements; determining an antenna pattern in accordance with a transmission/reception characteristic of a signal and assigning a weight to antenna elements in a position corresponding to the determined antenna pattern on the antenna array; implementing a rotation mode antenna based on the antenna element to which the weight is assigned; and transmitting or receiving a signal using the rotation mode antenna.

A plurality of rotation mode antennas may be implemented on the antenna array.

According to the present invention, the antenna pattern is variously reconfigured using a multi arrayed antenna structure, so that it is possible to stably transmitting and receiving a signal and simultaneously implement a plurality of antennas, thereby increasing a signal transmission/reception efficiency.

BRIEF DESCRIPTION OF THE DRAWINGS

FIG. 1 is a view illustrating a configuration of an array antenna apparatus for a rotation mode according to an exemplary embodiment of the present invention.

FIGS. 2A to 2C are exemplary views illustrating an exemplary embodiment of an antenna pattern of an array antenna apparatus for a rotation mode according to an exemplary embodiment of the present invention.

FIG. 3 is an exemplary view illustrating an exemplary embodiment which implements a multi antenna of an array antenna apparatus for a rotation mode according to the present invention.

FIGS. 4A and 4B are exemplary views illustrating an exemplary embodiment which implements a rotation mode of an array antenna apparatus for a rotation mode.

FIGS. 5A and 5B are exemplary views which are referred to explain a rotation mode antenna implementing operation according to an exemplary embodiment of an array antenna apparatus for a rotation mode according to the present invention.

FIGS. 6A to 6E are exemplary views which are referred to explain a rotation mode antenna implementing operation according to another exemplary embodiment of an array antenna apparatus for a rotation mode according to the present invention.

FIGS. 7A and 7B are exemplary views which are referred to explain a reception side rotation mode antenna implementing operation of an array antenna apparatus for a rotation mode according to an exemplary embodiment of the present invention.

FIG. 8 is an exemplary view which is referred to explain a transmission/reception side rotation mode antenna implementing operation of an array antenna apparatus for a rotation mode according to an exemplary embodiment of the present invention.

FIG. 9 is a flowchart illustrating an operational flow associated with a wireless communication method according to an exemplary embodiment of the present invention.

FIG. 10 is a block diagram illustrating a wireless communication terminal to which an array antenna apparatus for a rotation mode according to an exemplary embodiment of the present invention is applied.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

It should be noted that technical terminologies used in the present invention are used to describe a specific exemplary embodiment but are not intended to limit the present invention. Further, the technical terminologies which are used in the present invention should be interpreted to have meanings that are generally understood by those with ordinary skill in the art to which the present invention pertains, unless specifically defined to have different meanings in the present invention, but not be interpreted as an excessively comprehensive meaning or an excessively restricted meaning. Further, if a technical terminology used in the present invention is an incorrect technical terminology which does not precisely describe the spirit of the present invention, the technical terminology should be replaced with and understood as a technical terminology which may be correctly understood by those skilled in the art. Further, a general terminology used in the present invention should be interpreted as defined in a dictionary or in accordance with the context, but not be interpreted as an excessively restricted meaning.

A singular form used in the present invention may include a plural form unless it has a clearly opposite meaning in the context. Terminologies such as "be configured by" or "include" in the present invention should not be interpreted to necessarily include all of plural components or plural steps described in the present invention, but should be interpreted not to include some of the components or steps or to further include additional components or steps.

Terminologies including an ordinal number such as first or second which is used in the present invention may be used to explain components, but the components are not limited by the terminologies. The terminologies are used only for distinguishing one component from another component. For example, without departing from the scope of the present invention, the first component may be referred to as the second component, and similarly, the second component may also be referred to as the first component.

Hereinafter, exemplary embodiments according to the present invention will be described in detail with reference to the accompanying drawings, and the same or similar components are denoted by the same reference numerals regardless of reference numerals, and repeated description thereof will be omitted.

In describing the present invention, when it is determined that a detailed description of a related publicly known technology may obscure the gist of the present invention, the detailed description thereof will be omitted. Further, it is noted that the accompanying drawings are used just for easily appreciating the spirit of the present invention and it should not be interpreted that the spirit of the present invention is limited by the accompanying drawings.

FIG. 1 is a view illustrating a configuration of an array antenna apparatus for a rotation mode according to an exemplary embodiment of the present invention.

Referring to FIG. 1, an array antenna apparatus (hereinafter, referred to as an "antenna apparatus") for a rotation mode according to an exemplary embodiment of the present invention may include an antenna array 100 and a control unit 110 which implements a rotation mode antenna on the antenna array 100.

First, the antenna array 100 is configured by arranging a plurality of antenna elements 10. For example, the antenna array 100 may be implemented by arranging the antenna elements 10 in an M×N matrix. Here, as the antenna element 10, any antenna which forms a beam, such as a waveguide, a microstrip patch, or a slot, may be applicable.

As illustrated in FIGS. 2A to 2C, various types of the antenna array 100 may be implemented. For example, the antenna array 100 may be implemented by arranging the plurality of antenna elements 10 to have a diamond shape, as illustrated in FIG. 2A. Further, the antenna array 100 may be implemented by arranging the plurality of antenna elements 10 to have a diamond shape whose center is open, as illustrated in FIG. 2B. Further, the antenna array 100 may be implemented by arranging the plurality of antenna elements 10 to have a rectangular shape whose center is open, as illustrated in FIG. 2C. In addition, the antenna array 100 may be implemented to have a circle or a polygon having various shapes.

The control unit 110 determines an antenna pattern in accordance with a signal transmission/reception characteristic of the rotation mode antenna which will be implemented in the antenna array 100. Here, the antenna patterns correspond to individual antenna elements 10 on the antenna array 100. The control unit 110 may assign a weight for beam formation to the antenna elements 10 located in a position corresponding to the determined antenna pattern. Here, the weight is determined depending on an amplitude and a phase of a signal which is transmitted or received through the rotation mode antenna which will be implemented in the antenna array 100.

The control unit 110 applies the rotation mode to the antenna elements 10 to which the weight is assigned to implement the rotation mode antenna. In this case, the control unit 110 may implement a plurality of rotation mode antennas on one antenna array 100. The plurality of rotation mode antennas may be formed to have different shapes and sizes of the antenna patterns.

For example, the control unit 110 may implement at least two rotation mode antennas using one antenna pattern on the antenna array 100. In this case, the array antenna apparatus for a rotation mode may further include a mode coupler (not illustrated) which combines weights which are assigned to antenna elements 10 which form one antenna pattern, for every rotation mode antenna, in the unit of individual antenna elements 10. An operation of implementing the rotation mode antenna using the mode coupler will be described with reference to exemplary embodiments of FIGS. 5A and 5B. In this case, the control unit 110 may assign a weight which is combined by the mode coupler corresponding to the individual antenna elements 10 forming one antenna pattern, to the corresponding antenna element 10.

As another example, the control unit 110 may implement at least two rotation mode antennas using different antenna elements 10 on the antenna array 100. In this case, the control unit 110 may implement a rotation mode antenna for every region using antenna elements 10 in at least two regions which are spaced apart in parallel from each other on the antenna array 100. Detailed description thereof will be made by referring to an exemplary embodiment of FIG. 6A. Further, the control unit 110 may implement a rotation mode antenna for every region using antenna elements 10 in at least two circle regions which are spaced apart from each other with respect to one point on the antenna array 100. Detailed description thereof will be made by referring to exemplary embodiments of FIGS. 6B and 6C.

The control unit 110 may implement a rotation mode antenna for every region using antenna elements 10 in line regions which extend in different directions with respect to one point on the antenna array 100. Detailed description thereof will be made by referring to an exemplary embodiment of FIG. 6D. Further, the control unit 110 may implement at least two rotation mode antennas which intersect each other using antenna elements 10 in at least two regions which overlap on the antenna array 100. Detailed description thereof will be made by referring to an exemplary embodiment of FIG. 6E.

The at least two rotation mode antennas which are implemented on the antenna array 100 by the control unit 110 may be a reception side antenna or a transmission side antenna. In the meantime, the reception side rotation mode antenna and the transmission side rotation mode antenna may be simultaneously implemented on the antenna array 100.

Here, it is assumed that the rotation mode antenna basically operates in a circumstance where a line-of-sight (LOS) is maintained. In this case, a wireless communication system using the rotation mode antenna may become a high speed point to point communication system. In the case of a high speed point to point service, beam alignment is formed between antennas at an initial process, but precise beam alignment may not be formed due to various environmental factors. Accordingly, in order to minimize a link loss of the rotation mode antenna, the control unit 110 analyzes a reception power distribution of antenna elements 10 which configure a reception side rotation mode antenna, resets a center of the rotation mode antenna in accordance with the analysis result, and rearranges antenna patterns based on the reset center. Detailed description thereof will be made by referring to an exemplary embodiment of FIG. 7A.

Beams formed by the antenna elements 10 may gradually expand as the distance is increased. In the case of the rotation mode, a hole where there is no energy in the center of the beam is made, so that a size of the antenna pattern of the reception side rotation mode antenna needs to be increased in order to increase reception efficiency. Accordingly, the control unit 110 forms the antenna pattern of the reception side rotation mode antenna to have the same shape as an antenna pattern of the transmission side rotation mode antenna but to be larger than the antenna pattern of the transmission side rotation mode antenna.

In the meantime, when the transmission side rotation mode antenna and the reception side rotation mode antenna are simultaneously implemented in one antenna array 100, the control unit 110 implements the transmission side rotation mode antenna using antenna elements 10 located at a central region of the antenna array 100 and implements the reception side rotation mode antenna using antenna elements 10 of an outer peripheral region which is spaced apart from the central region.

FIG. 3 is an exemplary view illustrating an exemplary embodiment which implements a multi antenna of an array antenna apparatus for a rotation mode according to an exemplary embodiment of the present invention.

Referring to FIG. 3, an array antenna apparatus for a rotation mode may implement a plurality of rotation mode antennas on one antenna array. In this case, the array antenna apparatus for a rotation mode, as illustrated in FIG. 3, may form different types of antenna patterns 31, 33, 35, and 37 on the antenna array in accordance with a signal transmission/reception characteristic of the antenna. In this case, the number of antenna elements which form the antenna pattern and a width of the antenna element may be implemented in various ways in accordance with an antenna gain and a weight which is assigned to each of the antenna elements may be implemented in various ways in accordance with an amplitude and a phase of a signal which is transmitted or received through the rotation mode antenna.

FIGS. 4A and 4B are exemplary views illustrating an exemplary embodiment which implements a rotation mode of an array antenna apparatus for a rotation mode. Specifically, FIGS. 4A and 4B illustrate an example which implements a rotation mode antenna which rotates around a central point P with a phase difference of 360 degrees.

Here, the antenna apparatus assigns a weight to antenna elements which are located on a line of a circular pattern around the point P on the rectangular antenna array as illustrated in FIG. 4A and implements a rotation mode antenna having a phase difference of 360 degrees using the antenna elements to which the weight is assigned. In the meantime, the antenna apparatus assigns a weight to antenna elements which form a circular pattern except for the point P from the circular pattern with the point P at the center on a diamond shaped antenna array as illustrated in FIG. 4B and implements a rotation mode antenna having a phase difference of 360 degrees using the antenna elements to which the weight is assigned.

As illustrated in FIGS. 4A and 4B, even when the rotation mode antenna having the same characteristic is implemented, the antenna pattern may be implemented in various ways.

FIGS. 5A and 5B are exemplary views which are referred to explain explaining a rotation mode antenna implementing operation according to an exemplary embodiment of an array antenna apparatus for a rotation mode according to an exemplary embodiment of the present invention.

First, FIG. 5A illustrates an operation of combining weights which are assigned to one antenna element to implement a plurality of rotation mode antennas using the mode coupler 150 of the antenna apparatus and assigning the combined weight to the antenna element.

For example, when the antenna apparatus implements N rotation mode antennas using one antenna pattern on the antenna array, a total of N weights may be assigned to the antenna elements corresponding to the antenna pattern. In other words, a first weight Weight 1 for implementing a first rotation mode antenna and a second weight Weight 2 for implementing a second rotation mode antenna may be assigned to the first antenna element 51 and in this manner, a total of N weights from the first weight to N-th weight Weight N for implementing an N-th rotation mode antenna may be assigned. In this case, the mode coupler 150 combines all the first weight Weight 1 to N-th weight Weight N which are assigned to the first antenna element 51.

Similarly, the mode coupler 150 combines the first weight Weight 1 for implementing the first rotation mode antenna, the second weight Weight 2 for implementing the second rotation mode antenna, . . . and the N-th weight Weight N for implementing the N-th rotation mode antenna, using a second antenna element 53.

The mode coupler 150 may combine weights in the unit of antenna elements for all the antenna elements corresponding to the antenna pattern. In this case, the antenna apparatus assigns the weights which are combined by the mode coupler 150 to a corresponding antenna element.

As described above, an exemplary embodiment which assigns the weights combined by the mode coupler 150 to the antenna elements is illustrated in FIG. 5B. Here, the antenna pattern illustrated in FIG. 5B is obtained by combining a total of three rotation modes (m=−1, m=0, and m=+1) and the antenna apparatus may implement a rotation mode antenna in a stop mode (m=0) and implement a rotation mode antenna for a case (m=−1) when the antenna elements to which the weight is assigned rotate in a left direction as indicated by reference numeral 55. Further, the antenna apparatus may implement a rotation mode antenna for a case (m=+1) when the antenna elements to which the weight is assigned rotate in a right direction as indicated by reference numeral 57.

FIGS. 6A to 6E are exemplary views which are referred to explain a rotation mode antenna implementing operation according to another exemplary embodiment of an array antenna apparatus for a rotation mode according to an exemplary embodiment of the present invention.

The antenna apparatus may dispose the antenna patterns in various ways in order to implement a plurality of rotation mode antennas on one antenna array.

In this case, the antenna apparatus divides the antenna array into four regions 61, 63, 65, and 67 which are spaced apart from each other, as illustrated in FIG. 6A and configures an antenna pattern for implementing the rotation mode antennas in the divided regions 61, 63, 65, and 67.

Here, in a first region 61, an antenna pattern for implementing rotation mode antennas for (m=+1) is disposed and the antenna apparatus rotates the antenna elements corresponding to the antenna pattern disposed in the first region 61 in a right direction to implement the rotation mode antenna for (m=+1). In a second region 63 and a third region 65, a rotation mode antenna for (m=0) is implemented. Further, in a fourth region 67, an antenna pattern for implementing rotation mode antennas for (m=−1) is disposed and the antenna apparatus rotates the antenna elements corresponding to the antenna pattern disposed in the fourth region 67 in a left direction to implement the rotation mode antenna for (m=+1).

According to the exemplary embodiment of FIG. 6A, the antenna apparatus utilizes different regions of the antenna array to simultaneously implement the rotation mode antennas for (m=+1), (m=0), and (m=−1).

The antenna apparatus, as illustrated in FIGS. 6B and 6C, may implement the rotation mode antenna for every region using antenna elements in at least two circle regions which are spaced apart from each other with respect to any one point on the antenna array.

In FIG. 6B, the antenna apparatus implements the rotation mode antenna for (m=0) at a center and implements a rotation mode antenna for (m=+1) in a circle region which is outwardly spaced apart from the center. Further, the antenna apparatus implements a rotation mode antenna for (m=−1) in a circle region which is outwardly spaced apart from the rotation mode antenna for (m=+1). In the meantime, in FIG. 6C, the antenna apparatus implements the rotation mode antenna for (m=+1) and the rotation mode antenna for (m=−1) similarly to the exemplary embodiment of FIG. 6B and implements the rotation mode antenna for (m=0) in a region which is outwardly spaced apart from the rotation mode antenna for (m=+1), rather than the center.

The antenna apparatus, as illustrated in FIG. 6D, may implement the rotation mode antenna for every region using antenna elements in line regions which extend in different directions with respect to any one point on the antenna array. Here, the antenna apparatus implements a rotation mode antenna for (m=+1) to have a "+" shape and implements a rotation mode antenna for (m=−1) to have an "X" shape.

In the meantime, the antenna apparatus may implement at least two rotation mode antennas which intersect each other using antenna elements in at least two regions which overlap each other on the antenna array. It is confirmed that FIG. 6E is similar to a case when one antenna pattern is formed on the antenna array but antenna elements which configure the rotation mode antenna for (m=+1) and antenna elements which configure the rotation mode antenna for (m=−1) are disposed so as not to overlap each other.

FIGS. 7A and 7B are exemplary views which are referred to explain a reception side rotation mode antenna implementing operation of an array antenna apparatus for a rotation mode according to an exemplary embodiment of the present invention. In FIGS. 7A and 7B, even though description is made using a single antenna on an antenna array, for the convenience of description, it is obvious that when a plurality of rotation mode antennas is implemented, the same may be applied.

As described above, when the high speed point to point system is applied to the rotation mode antenna, precise beam alignment may not be formed between the transmission side and the reception side due to various environmental factors, so that the antenna apparatus analyzes a reception power distribution of the antenna elements which configure the reception side rotation mode antenna and resets the center of the rotation mode antenna in accordance with the analysis result in order to minimize the link loss of the rotation mode antenna.

In FIG. 7A, an initial rotation mode antenna is implemented by a circular pattern with respect to the point P of the antenna array as indicated by reference numeral 71. Thereafter, the antenna apparatus calculates a position of Q in accordance with the reception power distribution of a signal which is received by the antenna elements having a circular pattern and rearranges the antenna patterns by moving the center point from P to Q as indicated by reference numeral 73. In this case, the antenna apparatus may receive a signal using the rotation mode antenna having antenna patterns which are rearranged with respect to the point Q.

In FIG. 7B, when the antenna apparatus implements the reception side rotation mode antenna, the antenna pattern of the reception side rotation mode antenna is formed to have the same shape as the antenna pattern of the transmission side rotation mode antenna but be larger than the antenna pattern of the transmission side rotation mode antenna in consideration of a phenomenon that the beam formed by the antenna elements gradually expands as the distance is increased. In this case, the reception side rotation mode antenna is formed to be larger than the transmission side rotation mode antenna, thereby increasing reception efficiency.

FIG. 8 is an exemplary view which is referred to explain a transmission/reception side rotation mode antenna implementing operation of an array antenna apparatus for a rotation mode according to an exemplary embodiment of the present invention.

As illustrated in FIG. 8, the antenna apparatus may simultaneously implement the transmission side rotation mode antenna and the reception side rotation mode antenna on one antenna array.

In this case, the antenna apparatus forms the antenna pattern of the reception side rotation mode antenna to be large than the antenna pattern of the transmission side rotation mode antenna.

For example, in the case of reference numeral 81, a transmission side rotation mode antenna for (m=+1) is formed in an inner circle region and a reception side rotation mode antenna for (m=−1) is formed in a circle region which is outwardly spaced apart from the inner circle region. To the contrary, in the case of reference numeral 85, a reception side rotation mode antenna for (m=+1) for receiving a signal transmitted from the transmission side rotation mode antenna for (m=+1) denoted by reference numeral 81 is formed in an outer circle region and a transmission side antenna for (m=−1) is formed in a circle region which is inwardly spaced apart from the outer circle region.

In the case of the rotation mode antenna for (m=0), the transmission side rotation mode antenna and the reception side rotation mode antenna may be formed to have the same size.

A flow for a signal transmitting and receiving operation of an array antenna for a rotation mode according to the exemplary embodiment of the present invention configured as described above will be described below in more detail.

FIG. 9 is a flowchart illustrating an operational flow associated with a wireless communication method according to an exemplary embodiment of the present invention.

As illustrated in FIG. 9, an antenna apparatus configures an antenna array having an M×N structure using a plurality of antenna elements in step S110 and determines an antenna pattern in accordance with a reception characteristic of a reception side rotation mode antenna to be implemented in step S120. In this case, in step S120, the antenna apparatus may determine the number of antenna elements corresponding to the antenna pattern and a position and a width of the antenna element.

Next, the antenna apparatus assigns a weight to the antenna elements in a position corresponding to the antenna pattern determined in step S120 on the antenna array in step S130 and implements a reception side rotation mode antenna based on the antenna elements to which the weight is assigned in step S130 (step S140).

In this case, the antenna apparatus may receive a signal using the reception side rotation mode antenna which is implemented in step S140 (step S150).

Even though the exemplary embodiment of FIG. 9 describes an operation of receiving a signal using the reception side antenna apparatus, the transmission side antenna apparatus also transmits the signal through the same processes.

FIG. 10 is a block diagram illustrating a wireless communication terminal to which an array antenna apparatus for a rotation mode according to an exemplary embodiment of the present invention is applied.

Referring to FIG. 10, a wireless communication terminal according to an exemplary embodiment of the present invention may include a processor 1100, a memory 1300, a user interface input device 1400, a user interface output device 1500, a storage 1600, a network interface 1700, and an array antenna apparatus 1800 for a rotation mode. Individual units of the wireless communication terminal 1000 may be connected to each other by a bus 1200.

Specific description of the array antenna apparatus for a rotation mode has been made with reference to exemplary embodiments of FIGS. 1 to 8 and redundant description will be omitted.

Accordingly, the array antenna apparatus for a rotation mode transmits a transmission signal of a wireless communication terminal to an external terminal and a server. Further, the array antenna apparatus for a rotation mode receives a signal which is transmitted from the external terminal and the server. Here, it is considered that the array antenna apparatus for a rotation mode is implemented by the transmission side rotation mode antenna and the reception side rotation mode antenna. In this case, the transmission side rotation mode antenna and the reception side rotation mode antenna may be implemented on separate antenna arrays or simultaneously implemented on one antenna array.

The array antenna apparatus for a rotation mode may be implemented in a wireless communication terminal. In this case, the array antenna apparatus for a rotation mode may be formed to be integrated with internal control units of the wireless communication terminal. In the meantime, the array antenna apparatus for a rotation mode may be connected in the outside of the wireless communication terminal by a connecting unit.

The user interface input device is a unit which receives a control command from a user and may be a key button implemented at the outside of the wireless communication terminal and may be a software key implemented on a display of the wireless communication terminal. Further, the user interface input device may be an input unit such as a mouse, a joy stick, a jog shuttle, a stylus pen.

The user interface output device 1500 may include a display on which an operation state of the wireless communication terminal and a result thereof are displayed and a speaker which guides the operation state and a result by voice.

Here, when a sensor which detects a touch operation is included in the display, the display may be used not only as an output device, but also as an input device. That is, when a touch sensor such as a touch film, a touch sheet, or a touch pad is provided in the display, the display serves as a touch screen and the user interface input device and the user interface output device 1500 may be implemented to be combined.

In this case, the display may include at least one of a liquid crystal display (LCD), a thin film transistor liquid crystal display (TFT LCD), an organic light emitting diode (OLED), a flexible display, a field emission display (FED), and a three dimensional display (3D display).

The memory 1300 and the storage 1600 may include various types of volatile or non-volatile storage media. For example, the storage media may include at least one of a flash memory type, a hard disk type, a multimedia card micro type, a card type memory (for example, an SD or XD memory), a magnetic memory, a magnetic disk, an optical disk, a random access memory (RAM), a static random access memory (SRAM), a read-only memory (ROM), a programmable read-only memory (PROM), an electrically erasable programmable read-only memory (EEPROM), and at least one of the ROM and the RAM.

The network interface 1700 is a device which processes signals transmitted or received through the rotation mode antenna using a wireless Internet technology. Here, the wireless Internet technology may include a wireless LAN (WLAN), a wireless broadband (Wibro), a Wi-Fi, a world interoperability for microwave access (Wimax), or a high speed downlink packet access (HSDPA).

The processor 1100 may be a semiconductor device which may perform processings on commands which are stored in a central processing unit (CPU), or the memory 1300 and/or the storage 1600.

The method or a step of algorithm which has described regarding the exemplary embodiments disclosed in the specification may be directly implemented by hardware or a software module which is executed by the processor 1100 or a combination thereof. The software module may be stayed in the storing medium (that is, the memory 1300) and/or the storage 1600. An exemplary storage medium is coupled to the processor 1100 and the processor 1100 may read information from the storage medium and write information in the storage medium. As another method, the storage medium may be integrated with the processor 1100. The processor and the storage medium may be stayed in an application specific integrated circuit (ASIC). The ASIC may be stayed in a user terminal. As another method, the processor and the storage medium may be stayed in a user terminal as individual components.

The specified matters and limited exemplary embodiments and drawings such as specific elements in the present invention have been disclosed for broader understanding of the present invention, but the present invention is not limited to the exemplary embodiments, and various modifications and changes are possible by those skilled in the art without departing from an essential characteristic of the present invention. Therefore, the spirit of the present invention is defined by the appended claims rather than by the description preceding them, and all changes and modifications that fall within metes and bounds of the claims, or equivalents of such metes and bounds are therefore intended to be embraced by the appended claims.

What is claimed is:

1. An array antenna apparatus for a rotation mode, comprising:

an antenna array including a plurality of antenna elements; and a control unit which determines an antenna pattern in accordance with a transmission/reception characteristic of a signal and assigns a weight to antenna elements in a position corresponding to the determined antenna pattern on the antenna array to implement a rotation mode antenna based on the antenna element to which the weight is assigned, wherein the control unit implements a plurality of rotation mode antennas on the antenna array.

2. The array antenna apparatus of claim 1, wherein the control unit implements at least two rotation mode antennas using one antenna pattern on the antenna array.

3. The array antenna apparatus of claim 2, further comprising:

a mode coupler which combines weights which are assigned to the antenna elements which form the one antenna pattern for every rotation mode antenna in the unit of antenna elements.

4. The array antenna apparatus of claim 3, wherein the control unit assigns the weights which are combined by the mode coupler corresponding to the antenna element which forms one antenna pattern to the corresponding antenna element.

5. The array antenna apparatus of claim 1, wherein the control unit implements at least two rotation mode antennas using different antenna elements on the antenna array.

6. The array antenna apparatus of claim 5, wherein the control unit implements a rotation mode antenna for every region using antenna elements in at least two regions which are spaced apart in parallel from each other on the antenna array.

7. The array antenna apparatus of claim 5, wherein the control unit implements a rotation mode antenna for every region using antenna elements in at least two circle regions which are spaced apart from each other with respect to any one point on the antenna array.

8. The array antenna apparatus of claim 5, wherein the control unit implements a rotation mode antenna for every region using antenna elements in line regions which extend in different directions with respect to any one point on the antenna array.

9. The array antenna apparatus of claim 5, wherein the control unit implements at least two rotation mode antennas which intersect each other using antenna elements in at least two regions which overlap each other on the antenna array.

10. The array antenna apparatus of claim 1, wherein the control unit analyzes a reception power distribution of antenna elements which configure a reception side rotation mode antenna to rearrange antenna patterns of the rotation mode antenna in accordance with an analysis result.

11. The array antenna apparatus of claim 1, wherein the control unit forms the antenna pattern of a reception side rotation mode antenna to have the same shape as the antenna pattern of a transmission side rotation mode antenna but to be larger than the antenna pattern of the transmission side rotation mode antenna.

12. The array antenna apparatus of claim 1, wherein the control unit implements a transmission side rotation mode antenna using antenna elements which are located at a center region of the antenna array and implements a reception side rotation mode antenna using antenna elements in an outer peripheral region which is spaced apart from the center region.

13. The array antenna apparatus of claim 1, wherein the weight is determined depending on an amplitude and a phase of a signal which is transmitted or received through the rotation mode antenna.

14. The array antenna apparatus of claim 1, wherein a gain of the rotation mode antenna is increased in proportion to the number of antenna elements corresponding to the antenna pattern.

15. A wireless communication terminal comprising the array antenna apparatus for a rotation mode of claim 1, which transmits and receives a wireless signal using the array antenna apparatus for a rotation mode.

16. A wireless communication method, comprising:

configuring an antenna array including a plurality of antenna elements;

determining an antenna pattern in accordance with a transmission/reception characteristic of a signal and assigning a weight to antenna elements in a position corresponding to the determined antenna pattern on the antenna array;

implementing a rotation mode antenna based on the antenna element to which the weight is assigned; and transmitting or receiving a signal using the rotation mode antenna, wherein a plurality of rotation mode antennas is implemented on the antenna array.

* * * * *